US006280569B1

(12) United States Patent
Sheerer

(10) Patent No.: US 6,280,569 B1
(45) Date of Patent: Aug. 28, 2001

(54) COMPRESSION RINGS FOR COLUMN RELIEF IN CONTINUOUS COOKING VESSELS

(75) Inventor: Jay K. Sheerer, Hudson Falls, NY (US)

(73) Assignee: Andritz-Ahlstrom Inc., Glens Falls, NY (US)

( * ) Notice: Subject to any disclaimer, the term of this patent is extended or adjusted under 35 U.S.C. 154(b) by 0 days.

(21) Appl. No.: 09/404,587

(22) Filed: Sep. 24, 1999

Related U.S. Application Data

(60) Provisional application No. 60/104,401, filed on Oct. 15, 1998.

(51) Int. Cl.[7] ..... D21C 7/06

(52) U.S. Cl. ..... 162/52; 162/57; 222/564

(58) Field of Search ..... 162/19, 52, 57, 162/246; 220/660, 661, 669; 422/239, 292; 222/146.4, 564

(56) References Cited

U.S. PATENT DOCUMENTS

| | | | | |
|---|---|---|---|---|
| 3,035,963 | * | 5/1962 | Schnyder | 162/19 |
| 4,721,231 | | 1/1988 | Richter | 222/146.4 |
| 5,454,490 | * | 10/1995 | Johanson | 222/146.4 |

* cited by examiner

*Primary Examiner*—Dean T. Nguyen
(74) *Attorney, Agent, or Firm*—Nixon & Vanderhye P.C.

(57) ABSTRACT

The flow of a liquid slurry of comminuted cellulosic fibrous material (e.g. wood chips) in a vertical vessel is made more uniform by providing a plurality of vertically spaced sets of either substantially continuous or discontinuous protrusions which extend inwardly from the internal surface of the vessel a maximum distance of between about 2–12 inches. A preferred vessel is a continuous or batch digester. The protrusions may have an arcuate, rectangular, isosceles or scalene triangular, right triangular, or trapezoidal cross-section, and may be spaced from each other vertically between about 1–12 feet, and have a height of between about 1–3 feet. Discontinuous protrusions have a preferred arcuate spacing of between 1–10 feet.

11 Claims, 2 Drawing Sheets

COMPRESSION RINGS FOR COLUMN RELIEF IN CONTINUOUS COOKING VESSELS

CROSS-REFERENCE TO RELATED APPLICATION

This application is based on provisional application Ser. No. 60/104,401 filed Oct. 15, 1998, the disclosure of which is incorporated by reference herein.

BACKGROUND AND SUMMARY OF THE INVENTION

U.S. Pat. No. 5,454,490 entitled "CONICAL INSERTS FOR CHIP BIN" discloses a method and apparatus for improving the flow of wood chips through a vertical wood chip treatment vessel by introducing conical rings to the interior surface of the vessel. These frustum-shaped rings provide relief of compaction forces due to the weight of the material and promote the uniform movement and treatment of the chips in the vessel (typically referred to as a "chip bin"). However, the patent is primarily directed to treating chips in a relatively dry state, where bridging or compaction may occur. No liquids are typically present in such bins, though one form of treatment disclosed is the introduction of steam to the bin.

In copending U.S. patent applications Ser. No. 08/936,047 filed on Sep. 23, 1997 now U.S. Pat. No. 5,985,096 and Ser. No. 08/953,880 filed on Oct. 24, 1997 now U.S. Pat. No. 6,129,816 the movement through and treatment of cellulose material in vertical continuous digesters is discussed. In particular, these applications (the disclosures of which are incorporated by reference herein) discuss the various degrees of compaction that can occur in a vertical column of comminuted cellulosic fibrous material (for example, wood chips) and how this compaction affects both the movement of the column and the treatment of the material with treatment liquids, especially in the vicinity of the annular screen assemblies that are so common to vertical continuous cooking vessels. The various embodiments disclosed in these applications show how the movement and treatment can be made more uniform by introducing novel screen assembly geometries. The present invention also improves the uniformity of the movement of material in treatment vessels and thus improves the uniformity of the treatment.

Surprisingly, according to the invention it has been discovered that the vertical movement of comminuted cellulosic fibrous material slurries, such as wood chips slurries, can be improved (e.g. made more uniform) by providing protrusions on the internal substantially vertical surface of the cooking vessel. These protrusions may be substantially continuous, that is, substantially annular, or may be intermittently distributed about the circumference of the internal surface of the vessel. In one embodiment, the protrusions consist of or comprise one or more substantially annular rings. In another embodiment, the protrusions consist of or comprise one or more rows of two or more individual structures evenly distributed or non-evenly distributed about the circumference of the internal surface of the vessel. The protrusions (also called protuberances) may be aligned in one or more rows, or one row of protuberances may be off-set from an adjacent row. One or a plurality of rings or rows may be used in any part of a treatment vessel, for example, a digester, where column movement may be a problem. This includes in the top of the vessel, in the middle of the vessel, and in the bottom of the vessel.

Though the mechanism by which these protuberances promote the uniform movement of the cellulose material is uncertain, it is believed that the protuberances provide a temporary relief of the compressive forces within the column and thus the temporary relief of the normal forces on the internal surface of the vessel so that friction between the chip mass and the vessel wall is temporarily decreased or substantially eliminated. It is believed that this reduction in friction permits the cellulose material to more uniformly flow through the treatment vessel and allow more uniform treatment of the material.

The protuberances or substantially annular rings of the invention may take a variety of shapes or geometries. The geometry of the rings may take any form, but is typically a geometry that does not extend more than about one foot [0.3 meter] from the internal surface of the vessel [the vessel typically has an interior diameter of between about 10–40 feet]. In a preferred embodiment, the protuberances or rings do not extend more than about 4 inches [10 cm] from the vessel surface, preferably not more than about 2 inches [5 cm] from the surface. A preferred embodiment of the rings or protuberances is one having a taper in the direction of the movement of the material such that the upper internal diameter or radius of the protuberance or ring is greater than the lower internal diameter or lower internal radius of the ring or protuberance. The protuberance or ring preferably has a taper angle of about 70 degrees or less, typically 45 degrees or less, but is preferably 15 degrees or even 10 degrees or less, e.g. between about 5–15 degrees. The protuberance or ring may have a height of 3 feet [1 meter] or less, but is preferably 1 foot [0.3 meter] or less in height, e.g. about 0.5–3 feet [0.15–1 meter]. If two or more rings or rows are used, the rings or rows may be separated by 12 feet [4 meter] or more, or may be separated by only 6 feet [3 meter] or even 3 feet [1 meter], or only 1 foot [0.3 meter], e.g. between about 1–12 feet [0.3–4 meter].

The one or more rings or protuberances may be made from any appropriate material, for example, carbon steel or stainless steel or a nickel alloy, or plastic, for example Dupont Teflon®, or a Teflon® containing plastic, or having a polytetrafluoroethylene or like low friction material coating. They may be secured to the shell by any form of appropriate fastening, for example, they may be attached by welding, or adhesive, or by one or more mechanical fasteners (e.g. threaded fasteners).

In one embodiment of the invention, the one or more (e.g. 1–10) annular rings or protuberances are metallic and perform the dual role of enhancing column movement and providing a cathode or anode for anodic corrosion protection of the vessel.

According to one aspect of the present invention there is provided a method of treating a liquid slurry of comminuted cellulosic fibrous material (e.g. at about 8–20% consistency) in a substantially vertical vessel having an internal surface, comprising: (a) Introducing the slurry into the vessel so that the slurry moves substantially downwardly in the vessel in a column. And, (b) at a plurality of vertically spaced locations in the vessel temporarily relieving compressive forces within the column and the normal forces on the internal surface of the vessel so that friction between the comminuted material and the vessel internal surface is temporarily decreased, or substantially eliminated, providing more uniform flow of the material in the vessel.

In the method (b) may be practiced to temporarily reduce the friction by at least 20% (e.g. 20–99%). Typically (b) is practiced by providing a plurality of vertically spaced compression-relieving surface manifestations on the internal surface of the vessel. For example, (b) is further practiced by providing at least one substantially continuous annular element having an inner surface that protrudes into the vessel from the internal surface a greater distance at a lower portion thereof than at a higher portion thereof. That is, (b) may be further practiced by providing a curved inner surface; or a sloped inner surface having an angle with respect to the vertical of between about 5–15°; and/or (b) is further practiced by vertically spacing at least some manifestations between about 1–12 feet, and by providing the manifestations so that the maximum radial spacing thereof from the internal surface is between about 1–12 inches.

In one embodiment (b) is further practiced by providing at least one surface manifestation with an inner surface which contacts the slurry column of a material having low friction properties substantially the same as polytetrafluoroethylene.

The method may further comprise (c) cooking the material of the slurry in the vessel at a temperature above 90° C. with a cooking liquid, e.g. by cooking the material with kraft cooking liquor at superatmospheric pressure and at a temperature above 100° C. (e.g. 140–160° C.).

According to another aspect of the invention there is provided: A substantially vertical vessel having an internal surface comprising: A plurality of vertically spaced sets of circumferentially discontinuous protrusions extending inwardly from the internal surface a maximum distance of about 1–12 inches. An inlet at or near a top portion of the vessel. And, an outlet at or near a bottom portion of the vessel. For example, the protrusions have an arcuate cross-section, or a substantially isosceles or scalene triangular, or rectangular cross-section. Typically the protrusions have a height of between about 1–3 feet, and a vertical spacing between at least two sets of between about 1–12 feet. For example, at least two sets of protrusions vertically spaced between about 1–12 feet have the protrusions thereof circumferentially offset from one set to the next. Also the protrusions may be circumferentially spaced from each other between about 5–30°, and an arcuate distance of between about 1–10 feet.

According to another aspect of the present invention there is provided a method of treating a liquid slurry of comminuted cellulosic fibrous material in a substantially vertical vessel having an internal surface, comprising: (a) Introducing the slurry into the vessel so that the slurry moves substantially downwardly in the vessel in a column. And, (b) at a plurality of vertically spaced locations in the vessel, causing the slurry to flow over surface manifestations which extend into the vessel a maximum distance of between about 1–12 inches. In the method (b) may be further practiced by providing a plurality of circumferentially discontinuous protrusions at each of a plurality of different levels within the vessel. Other details and modifications may be as described above.

According to yet another aspect of the present invention there is provided a substantially vertical vessel having an internal surface, and comprising: An inlet at or adjacent a top portion of the vessel. An outlet at or adjacent a bottom portion of the vessel. And, at least one substantially continuous annular protrusion connected to the internal surface and in a substantially horizontal plane, and having a maximum spacing from said internal surface of between about 1–12 inches, the protrusion having a cross-section selected from the group consisting essentially of right triangular, scalene triangular, isosceles triangular, arcuate, and rectangular. The protrusions may have a substantially isosceles triangular cross-section with an apex angle between about 90–175°, or may be arcuate in cross-section with a radius of curvature equal to or greater than its height. The vessel may further comprise a plurality of the protrusions, vertically spaced from each other between about 1–12 feet, and each having a height of between about 1–3 feet.

It is the primary object of the present invention to provide a method and vessel which effect more uniform flow (and thus typically uniform treatment) of material, such as cellulosic fibrous material slurry, e.g., in a digester. This and other objects of the invention will become clear from the detailed description of the invention and from the appended claims.

DETAILED DESCRIPTION OF THE DRAWINGS

Figure 1:
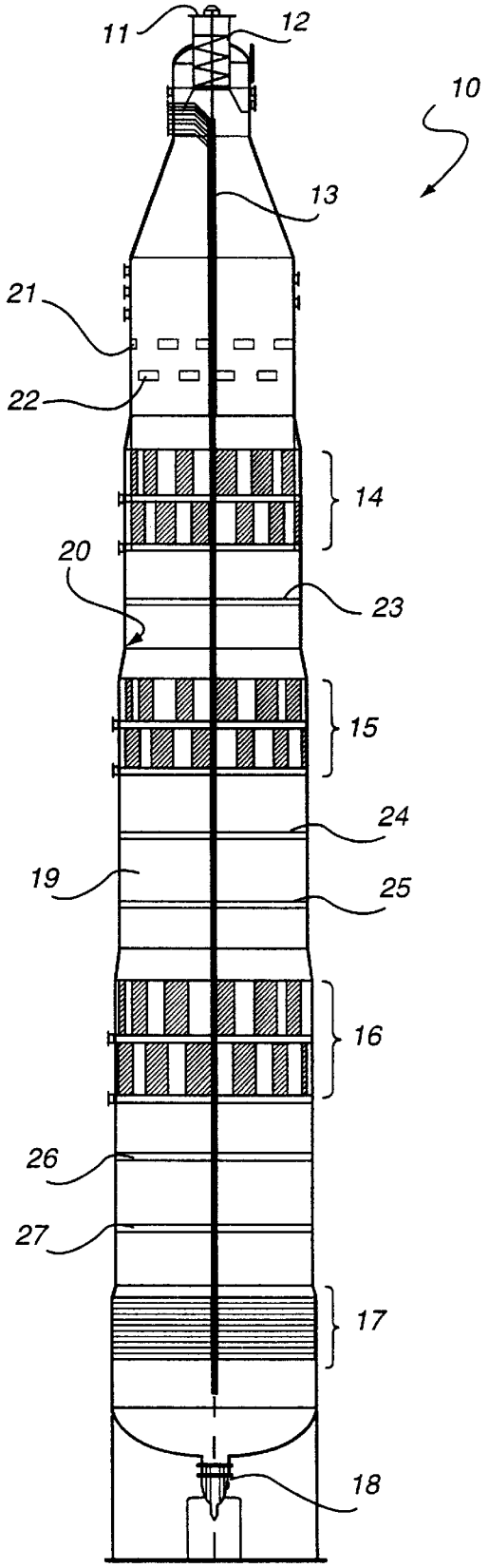
FIG. 1 is a schematic side view, with the near wall portion removed for clarity of illustration, of an exemplary continuous digester according to the invention for practicing the methods of the invention.

FIG. 1 illustrates a typical vertical continuous digester 10 in which the present invention is embodied or can be used. This digester includes an inlet 11 for a slurry of cellulose chips or the like and liquid, a conventional liquid separating device 12, a conventional central pipe for distributing treatment liquid 13, one or more conventional screen assemblies 14, 15, 16, and 17 for removing liquid form the slurry, an outlet 18, and a vessel shell 19 having an internal surface 20. According to the present invention the vessel shell 19 also includes one or more rings, or rows, of protuberances, 21, 22, 23, 24, 25, 26 and 27. These rings, or rows, of protuberances, may be located in any part of the vessel where column movement may be effected.

Figure 2:
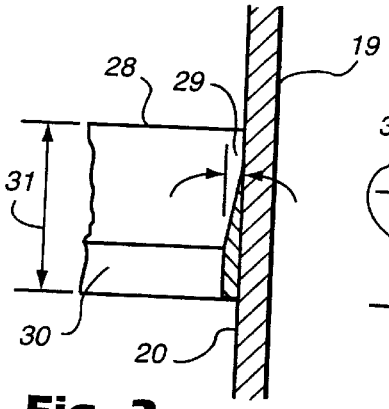
FIGS. 2–7 are detail schematic cross-sectional views of various forms that the protrusions illustrated in FIG. 1 can take pursuant to the invention.

FIGS. 2 through 7 illustrate various exemplary geometries of the rings or protuberances 21 through 27 shown in FIG. 1 for the vessel shell 19 having an internal surface 20. FIG. 2 illustrates a single ring 28 having a convergent angle 29 of between about 5–25 degrees to the vertical, preferably between about 5–15 degrees. The length of the vertical surface 30 may be from 1 to 90% of the height 31 of the ring 28. There may also be no vertical surface 30.

Figure 3:
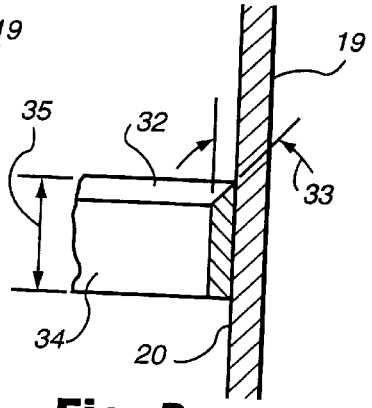

FIG. 3 illustrates another ring 32 geometry similar to FIG. 2 having a convergent angle 33 between about 10 and 70 degrees to the vertical, preferably between about 40 to 50 degrees, most preferably about 45 degrees. The vertical surface 34 may extend from 1 to 90% of the length 35 of the ring 32. There may also be no vertical surface 34.

Figure 4:
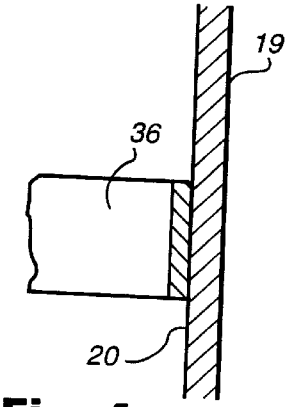

FIG. 4 illustrates another ring 36 having no tapered edges but simply having a rectangular cross-section.

The structures shown in FIGS. 2, 3 and 4 may represent the cross-sections of substantially continuous annular rings (23–27 in FIG. 1), or of two or more individual protuberances spaced circumferentially from each other (see 21 and 22 in FIG. 1) that may be used according to the present invention. When the protuberances in a set are circumferentially spaced from each other, the circumferential spacing is typically between about 5–30°, with a spacing arcuate length of between about 1–10 feet.

Figure 5:
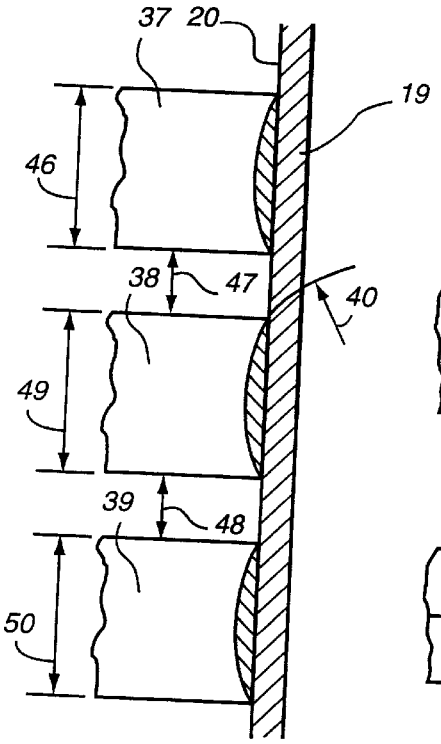

FIG. 5 illustrates an embodiment having three curved annular (or discontinuous) protuberances 37, 38, and 39 substantially equally spaced from each other vertically. That is the protrusions 37–39 have a substantially arcuate cross-section. The radius of curvature 40 of the curved surfaces may vary as required (e.g. be substantially equal to or greater than the height 49 of the associated protuberances 38). The radius of curvature of adjacent rings or protuberances 37–39 may be different, or the same.

Figure 6:
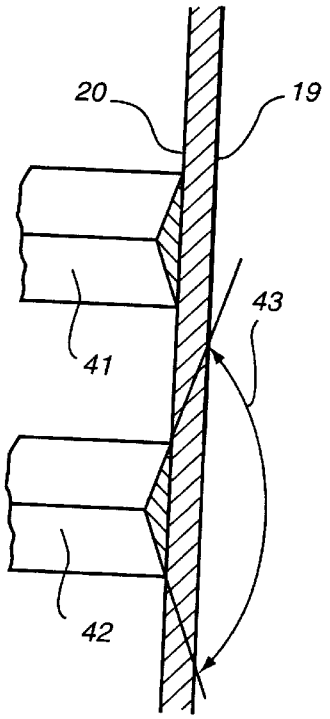
Figure 7:
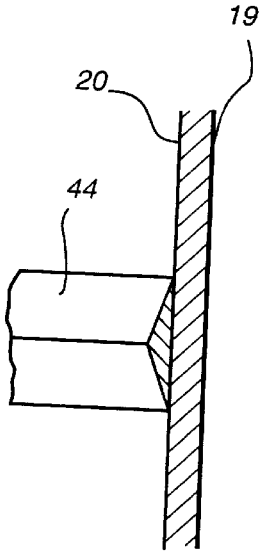

FIG. 6 illustrates another set of annular rings or protuberances 41, 42 having a triangular cross section. The triangular section may by isosceles in cross section, as shown, or may be scalene in cross section. The angle 43 of the apex of the triangle cross section may vary from between 10 to 179 degrees, but is preferably between about 90 and 175 degrees. The apex angle 43 of adjacent rings or protuberances may be different from each other, or the same. FIG. 7 illustrates a single row or ring 44 similar to the rings 41,42 of FIG. 6.

The typical height of a protrusion, e.g. the height 46 for protrusion 37 (in FIG. 5), is between about 1–3 feet, and the vertical spacing between some protrusions, e.g. the spacing 47 (FIG. 5), is preferably between about 1–12 feet. The spacing 48 may be the same as, or different from, the spacing 47, and the heights 49, 50 may be the same as or different from the height 46, and from each other.

The protrusions shown in any of the drawing figures may be of metal, such as carbon steel, stainless steel, nickel alloy, or the like, or may be plastic. They may comprise, include, be coated with, or contain a low friction material such as a material having low friction properties substantially the same as polytetrafluoroethylene (like polytetrafluoroethylene itself). In one embodiment of the invention, the one or more (e.g. 1–10) annular rings or protuberances are metallic and perform the dual role of enhancing column movement and providing a cathode or anode for anodic corrosion protection of the vessel.

Though the present invention is described above in reference to a continuous digester (and use therewith is particularly advantageous), it is to be understood that the invention is applicable to any type of vessel 19 in or through which particulate material is stored, treated or transferred, for example, cellulose pulp digesters, continuous or batch; storage towers or vessels; treatment towers, for example, bleach towers; chip bins; grain silos; and other similar vessels. While also applicable to dry material, the constructions are particularly useful in association with liquid slurries, e.g. having consistencies between about 1–40% (e.g. between about 8–20%).

Thus, according to the present invention a method and apparatus for improving the movement of cellulose material through treatment vessels and improving the treatment of cellulose material in those vessels is provided. While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of this specification, including, but not limited to, all narrower ranges within a broad range (e.g. between 1–12 feet means 2–4 feet, 3–8 feet, and all other narrower ranges between 1–12 feet). Also conventional equivalents of all components discussed above may be substituted.

What is claimed is:

1. A method of treating a liquid slurry of comminuted cellulosic fibrous material in a substantially vertical vessel having an internal surface, comprising:

(a) introducing the slurry into the vessel so that the slurry moves substantially downwardly in the vessel in a column; and (b) at a plurality of vertically spaced locations in the vessel temporarily relieving compressive forces on the comminuted cellulosic fibrous material within the column and the normal forces on the internal surface of the vessel so that friction between the comminuted material and the vessel internal surface is temporarily decreased, or substantially eliminated, providing more uniform flow of the material in the vessel.

2. A method as recited in claim 1 wherein (b) is practiced to temporarily reduce the friction by at least 20% for a slurry with a consistency between about 8–20%.

3. A method as recited in claim 1 wherein (b) is practiced by providing a plurality of vertically spaced compression-relieving surface manifestations on the internal surface of the vessel.

4. A method as recited in claim 3 wherein (b) is further practiced by providing at least one substantially continuous annular element having an inner surface that protrudes into the vessel from the internal surface a greater distance at a lower portion thereof than at a higher portion thereof.

5. A method as recited in claim 4 wherein (b) is further practiced by providing a curved inner surface.

6. A method as recited in claim 4 wherein (b) is further practiced by providing a sloped inner surface having an angle with respect to the vertical of between about 5–70°.

7. A method as recited in claim 3 wherein (b) is further practiced by vertically spacing at least some manifestations between about 1–12 feet, and providing the manifestations so that the maximum radial spacing thereof from the internal surface is between about 1–12 inches.

8. A method as recited in claim 3 wherein (b) is further practiced by providing at least one surface manifestation with an inner surface which contacts the slurry column of a material having low friction properties substantially the same as polytetrafluoroethylene.

9. A method as recited in claim 3 further comprising (c) cooking the material of the slurry in the vessel at a temperature above 90° C. with a cooking liquid.

10. A method as recited in claim 9 wherein (c) is practiced by cooking the material with kraft cooking liquor at a temperature above 100° C., while it has a consistency of between about 8–20%.

11. A method as recited in claim 3 wherein (b) is further practiced by providing a plurality of circumferentially discontinuous protrusions at each of a plurality of different levels within the vessel.

* * * * *